United States Patent [19]

Bell et al.

[11] Patent Number: 4,714,135

[45] Date of Patent: Dec. 22, 1987

[54] RAPPEL RESCUE SYSTEM

[75] Inventors: Robert L. Bell, Verona, N.J.; Joseph J. Dillon, Malverne, N.Y.

[73] Assignee: Rappel Rescue Systems, Inc., Fairfield, N.J.

[21] Appl. No.: 820,962

[22] Filed: Jan. 22, 1986

[51] Int. Cl.[4] ..... A62B 1/14; A62B 35/00

[52] U.S. Cl. ..... 182/6; 182/70

[58] Field of Search ..... 182/5–8, 182/190, 191, 192, 70; 188/65.1–65.4

[56] References Cited

U.S. PATENT DOCUMENTS

| | | | |
|---|---|---|---|
| 129,179 | 7/1872 | Harrison et al. | 182/191 |
| 291,940 | 1/1884 | Robertson | 182/191 |
| 505,706 | 9/1893 | Fowler | 182/191 |
| 553,190 | 1/1896 | Fowler | 182/191 |
| 573,739 | 12/1896 | Wethered | 182/191 |
| 689,850 | 12/1901 | Bustin | 182/191 |
| 785,019 | 3/1905 | Parker | 182/190 |
| 890,898 | 6/1908 | Gaillae | 182/191 |
| 1,351,734 | 9/1920 | Barrington | 182/5 |
| 1,497,534 | 6/1924 | Bass | 182/193 |
| 1,852,887 | 4/1932 | Lossius | 182/191 |
| 2,933,157 | 4/1960 | Huber | 182/193 |
| 2,970,357 | 2/1961 | Pinson | 182/193 |
| 3,757,901 | 9/1973 | Hobbs | 188/65.4 |
| 3,814,210 | 6/1974 | Hoffman | 182/6 |
| 4,102,431 | 7/1978 | Carroll | 182/5 |
| 4,296,836 | 10/1981 | Cooper | 182/193 |
| 4,493,391 | 1/1985 | Van Patten | 182/6 |
| 4,503,933 | 3/1985 | O'Neill | 182/231 |
| 4,508,193 | 4/1985 | Forrest | 182/5 |

FOREIGN PATENT DOCUMENTS

| | | | |
|---|---|---|---|
| 2406603 | 2/1974 | Fed. Rep. of Germany | 182/5 |

*Primary Examiner*—Reinaldo P. Machado
*Attorney, Agent, or Firm*—Martin A. Levitin

[57] ABSTRACT

A compact, rapidly-deployable rappel rescue system is housed in a lightweight carrier and connected to a belt or harness for portable use or mounted in a stationary position readily available for emergency use. The carrier contains a carabiner connected to one end of a tubularly woven Kevlar aramid fiber of similar lightweight, high strength synthetic polymer rappel line folded into a deployment bag, an edge guard protective sleeve pad slidable on the line and adjustable to the rappel point, a modified figure-of-eight multi-configuration descender and an end-stop ring connected to the other end of the rappel line.

7 Claims, 12 Drawing Figures

RAPPEL RESCUE SYSTEM

FIELD OF THE INVENTION

This invention relates generally to devices for use in rappelling or descending in a controlled manner down the sheer face of a cliff in mountain climbing, the side or interior shaft of a high-rise building to escape from fire or other danger, or to provide entry into a mine or cave. These novel devices are also capable of carrying extremely heavy loads and are therefore useful as rapid and safe rescue apparatus by policemen, firemen, military units or even laymen with minimal training.

BACKGROUND OF THE INVENTION

The idea of using fire escapes, ladders, scaffolds and the like as evacuation means from burning structures is well known. A body of art has developed, as well, which utilizes various seats, ropes, friction brakes and other cumbersome apparatus to carry out the objective of permitting escape from harm from an upper story of a building during an emergency. These devices were, in some instances, recommended for stationary installations in locations where their emergency use might be needed or were portable devices brought to the scene by would-be rescuers. It is believed that none of these devices has been commercially successful nor widely adopted.

The self-contained portable or stationary rappel system of the instant invention is characterized by rapidity of deployment, simplicity of use, ease of operation and fingertip control over rate of descent. It is light in weight, unusually strong, versatile, durable and has a virtually unlimited shelf-life. Whereas the structures and apparatus described in the prior art were, in most instances, inordinately complicated and required elaborate training in their use, the use of the instant device can be easily taught to rescue personnel or learned on the spot by evacuees if necessity warrants.

It is accordingly a principal object of the present invention to overcome the disadvantages of the prior art apparatus by providing novel, moderately-priced, portable or stationary, single or multiple line, short, medium or long line rappel rescue systems enabling rapid and safe vertical descent from a higher to a lower level.

Other objects of the present invention are to provide relatively low-cost, self-contained, compact rappel rescue systems for use by police departments, fire departments, military units and professionally-trained building evacuation and rescue units.

The above and other features, objects and advantages of the invention will become more apparent from the following description and claims in connection with the accompanying drawings to be described hereinafter.

SUMMARY OF THE INVENTION

Briefly described, the invention provides a carrier and a harness; the carrier compactly contains a carabiner (oblong mountain-climber's ring that snaps to an eye or chain link) sewn onto the rappel line, a length of rappel line of tubular high tensile synthetic material woven for maximum strength and folded into a rapid deployment bag, steel-reinforced edge-guard pad constructed as a movable sleeve over the rappel line, a novel "figure-of-eight" type descender of lightweight, high-tensile-strength alloy and an end-stop ring at the end of the line. The carrier also provides an attachment means for quick connection of the carrier to the harness and a means for opening it instantly by a single-handed pull of a rip cord device.

In employing the device, the rip cord is pulled and the line will feed from the carrier in the required sequence for use: carabiner for anchoring to an appropriate fixed member, edge guard pad for positioning where the line meets the rappel point such as the building fascia, window ledge, cliff edge, etc., descender for attachment to a hook which is built into the harness, a measured length of rappel line in a deployment bag and an end-stop ring. The deployment bag allows the entire line to be removed from the carrier and simply dropped; as the deployment bag falls to the ground the rappel line will automatically deploy ready for use. Alternatively, the line may also be deployed from the carrier while rappelling.

BRIEF DESCRIPTION OF THE DRAWINGS

The foregoing and other features of the present invention are more fully described with reference to the following drawings annexed hereto, in which.

DESCRIPTION OF THE PREFERRED EMBODIMENTS

Figure 1:
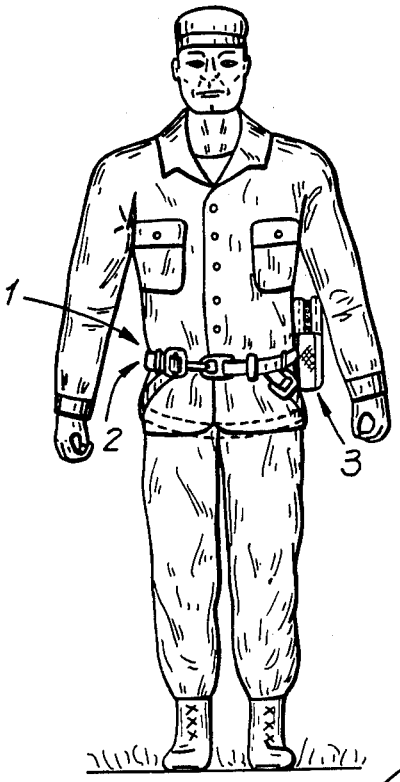
FIG. 1 illustrates rescuer wearing the rappel rescue system of the inventinon prior to deployment.

Referring first to FIG. 1, the portable rappel rescue system is generally designated by the numeral 1, has a body harness 2 detachably connected to a carrier 3. The carrier is constructed of lined heavy-duty cordura nylon.

Figure 2:
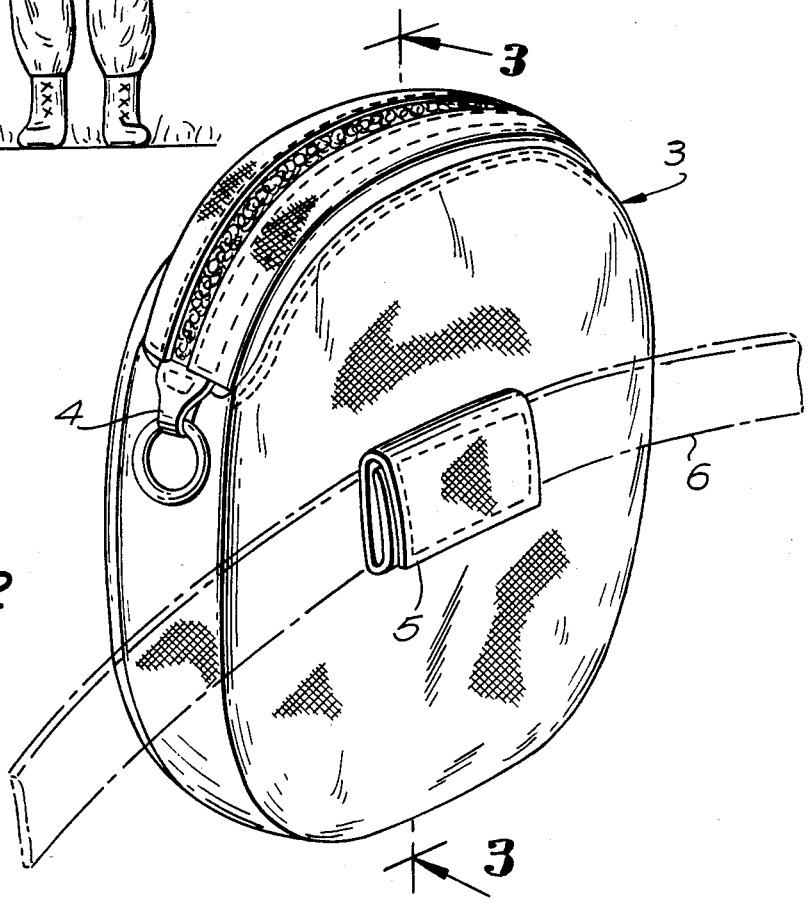
FIG. 2 is a perspective view of the carrier for the rappel rescue system of the invention prior to deployment showing the rip cord and the carrier-to-body harness fastener.

As best seen in FIG. 2, the carrier has a rip cord 4 which can be pulled by one finger to commence rapid deployment of the components of the rappel rescue system. FIG. 2 also shows the fastening device 5 which connects the carrier to the body harness and consists of velcro pads which wrap around the belt 6 of the body harness.

Figure 3:
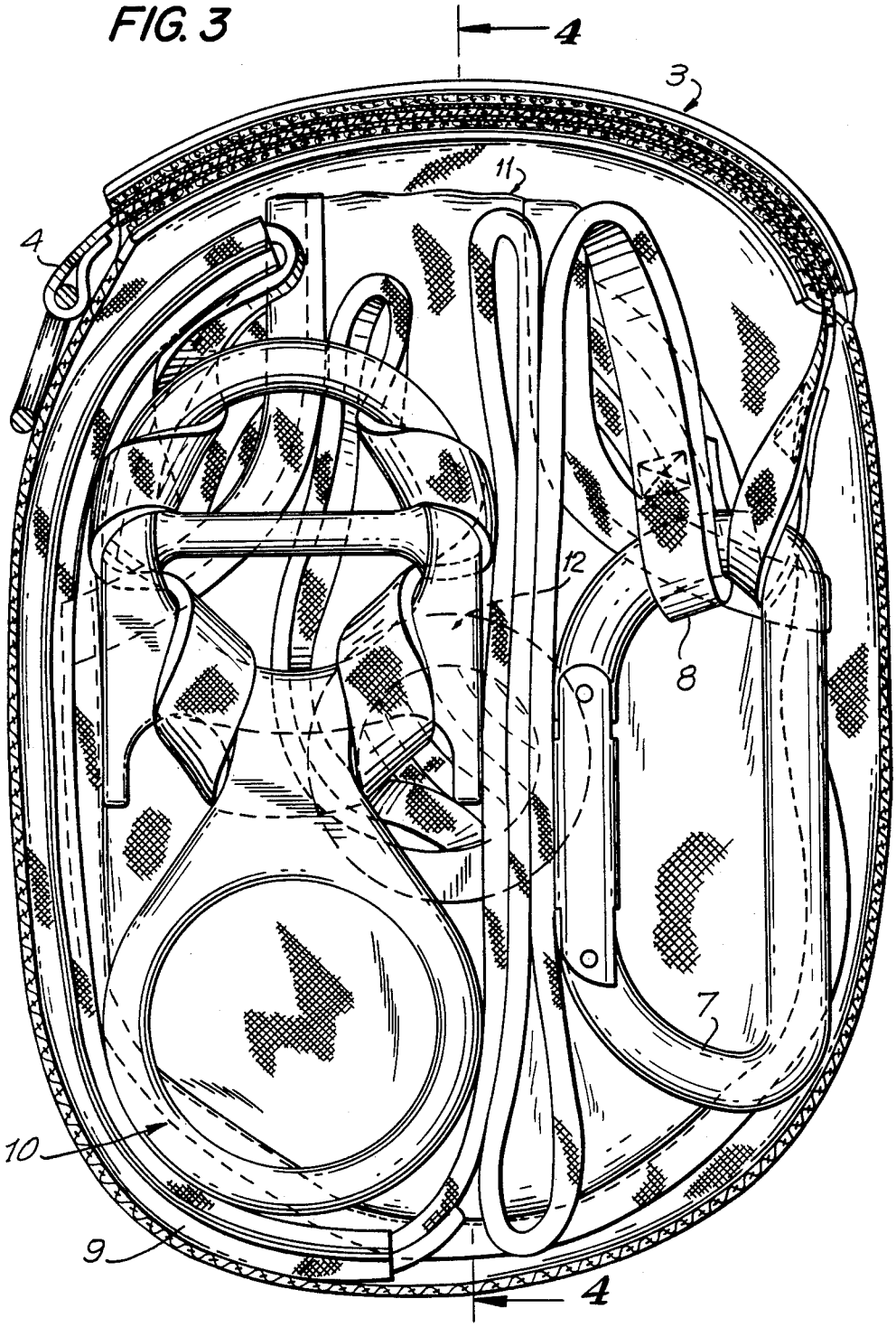
FIG. 3 is a sectional view of the contents of the carrier along lines 3—3 of FIG. 2. It is also a view of the unique descender of the invention showing the rappel line attached in a configuration permitting slow-speed, high-load-bearing, fingertip-controlled descent.
Figure 4:
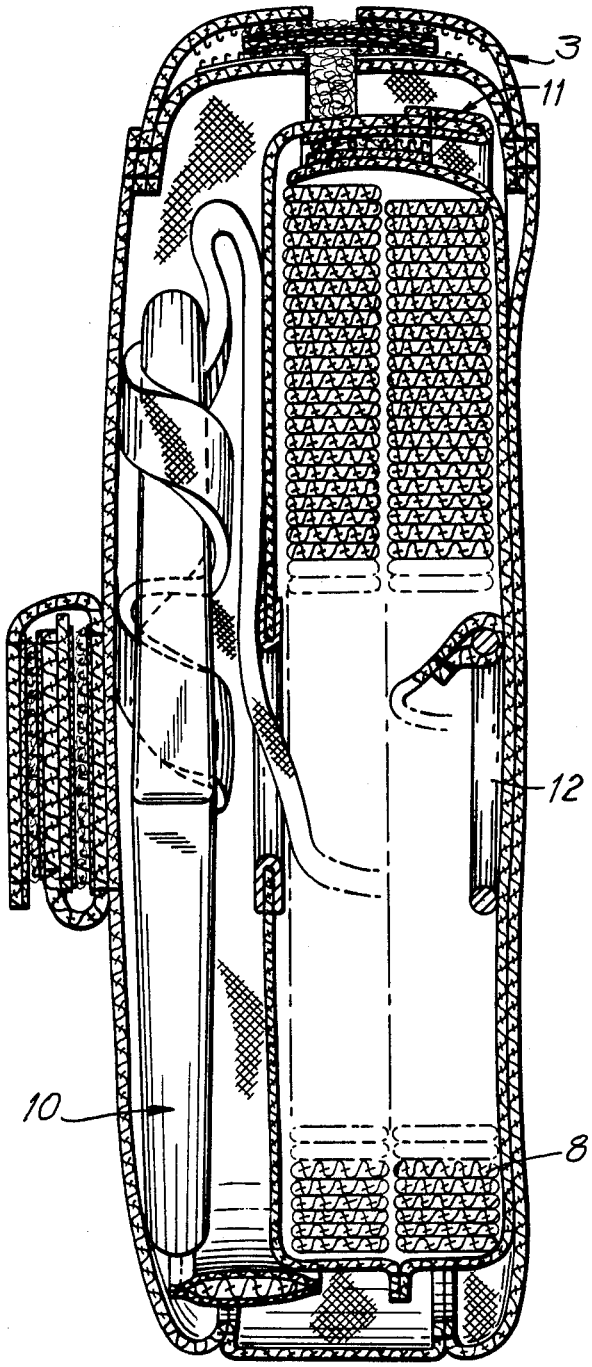
FIG. 4 is a sectional view of the contents of the deployment bag along lines 4—4 of FIG. 3.

As seen in FIGS. 3 and 4, the components of the system, compactly stowed in the carrier, feed out sequentially upon pulling the rip cord 4, and include the carabiner 7, the initial reinforced portion of the rappel line 8, the edge guard pad 9, the descender 10, the remaining rappel line in its deployment bag 11 and the end-stop ring 12.

Figure 5:
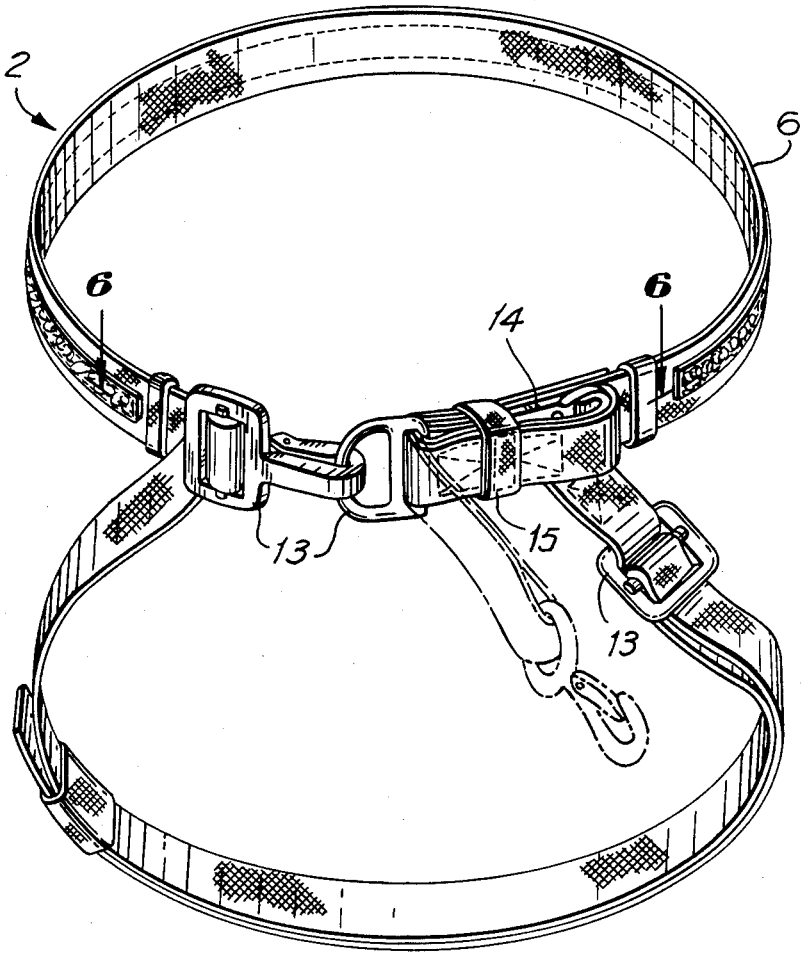
FIG. 5 is a perspective view of the body harness for the rappel rescue system of the invention; a phantom view of the safety hook fully deployed is also shown.
Figure 6:
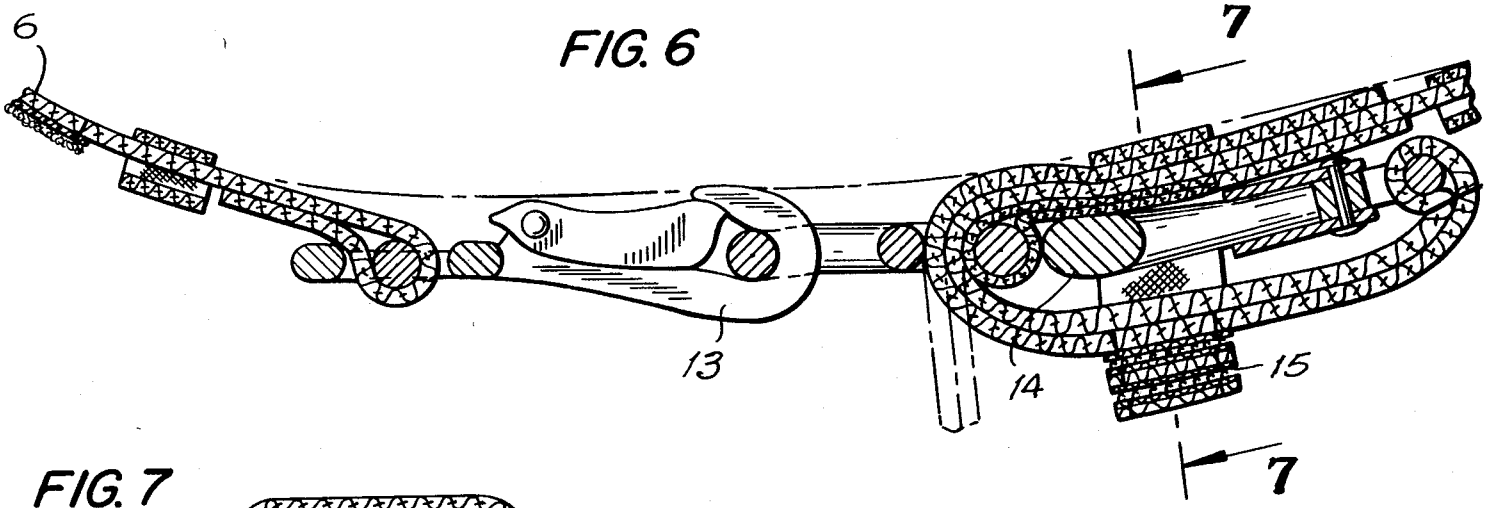
FIG. 6 is a sectional view of the body harness along lines 6—6 of FIG. 5.
Figure 7A:
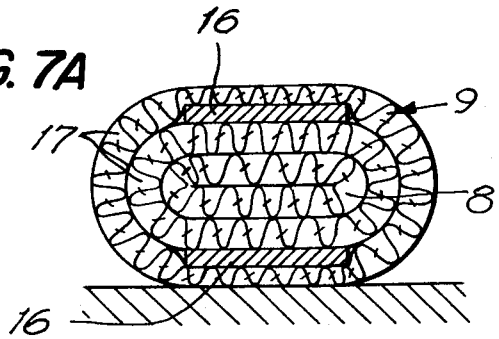
FIG. 7A is a sectional view of the edge guard pad of the invention along lines 7A—7A of FIG. 9.
Figure 7:
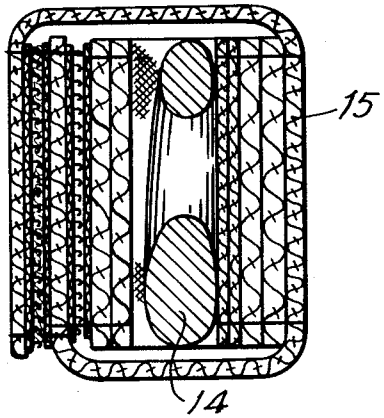
FIG. 7 is a sectional view of the body harness along lines 7—7 of FIG. 6.

FIG. 5 shows the body harness, which is constructed of military specification 1 23/32= nylon webbing and rigged with Forgecraft proof-tested hardware 13. The belt is adjustable for waist sizes from 22 inches to 50 inches. The harness is also adaptable to be worn in either a waist, seat or chest mode for desired operations. A safety hook 14 is also provided on the front of the harness belt and is deployable from a velcro fastener pack 15 shown in FIG. 6 and FIG. 7. FIG. 7A shows a cross-section of the movable edge guard protective pad showing the flexible steel banding 16 sandwiched between layers of woven Kevlar 17.

Figure 8:
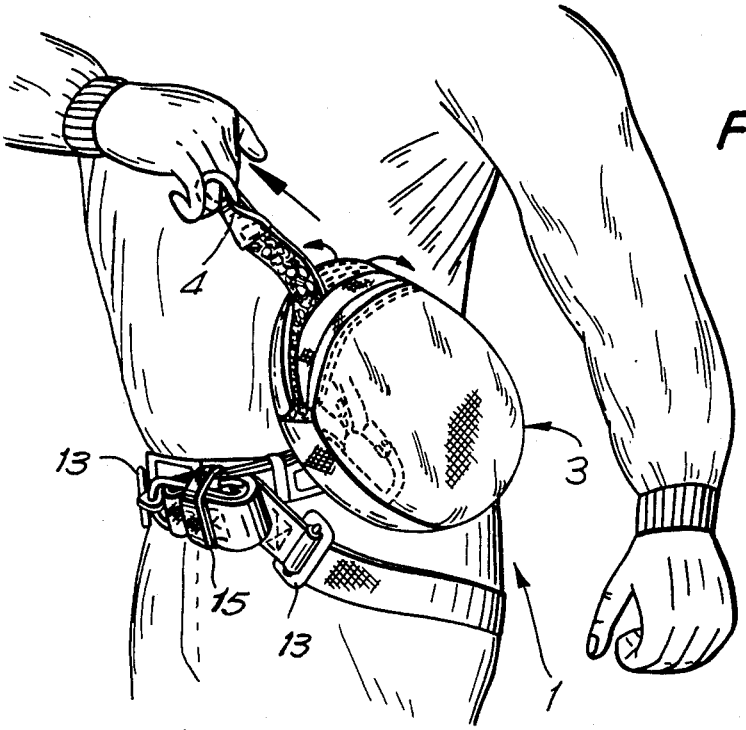
FIG. 8 is a perspective view of rescuer commencing deployment of the rappel rescue system of the invention by yanking the rip chord.

FIG. 8 shows the rescuer pulling the rip cord on the top of the carrier to commence deployment of the rappel rescue system. The rip cord is held in place by velcro fasteners forming the top closure for the carrier.

Figure 9:
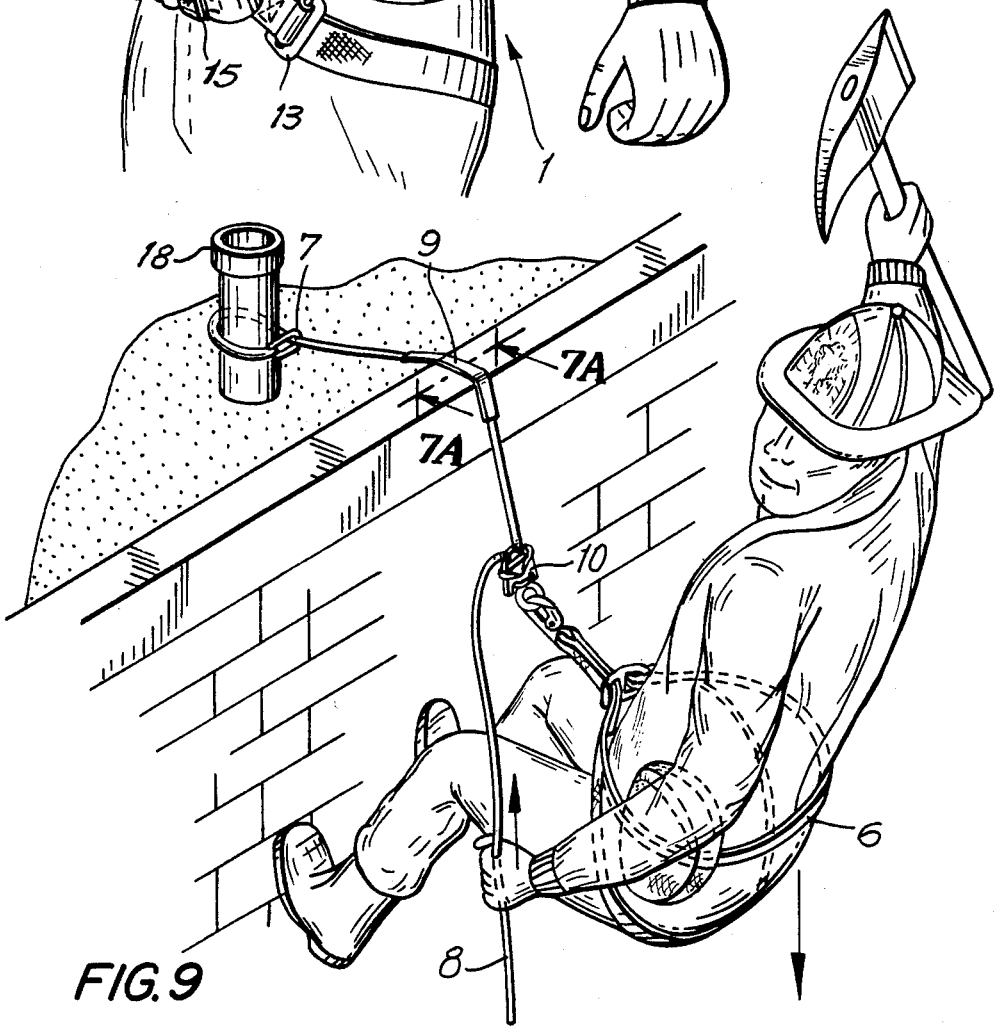
FIG. 9 is a perspective view of rescuer commencing descent utilizing the fully-deployed rappel rescue system of the invention.

FIG. 9 shows the rescuer commencing descent following connection of the carabiner 7 to the rappel line 8 to form a loop around a fixed object 18 and placement of the edge guard pad 9 on the building edge.

Figure 11:
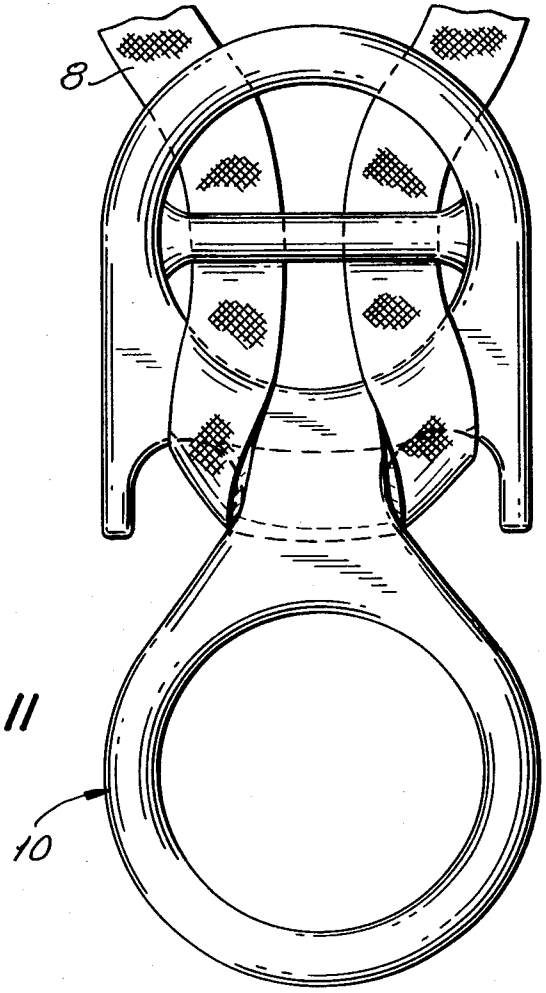
FIG. 11 is a view of the unique descender of the invention showing the rappel line attached in a configuration permitting high-speed descent.
Figure 10:
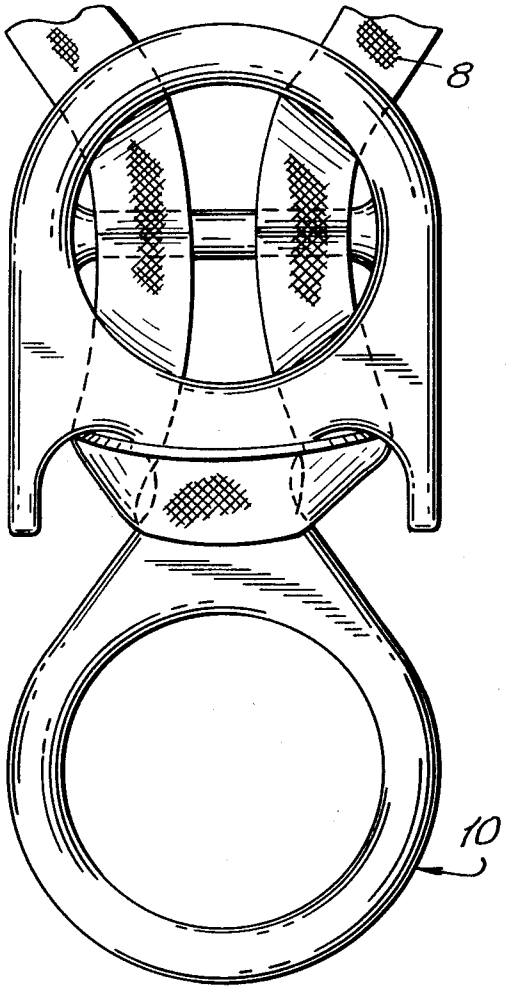
FIG. 10 is a view of the unique descender of the invention showing the rappel line attached in a configuration permitting moderate-speed controlled descent.

FIGS. 10 and 11 show the novel descender of the invention configured for two additional speeds and load bearing requirements of descent which this device makes possible. FIG. 10 shows the configuration for rapid descent useful in tactical operations, such as law enforcement actions or military maneuvers. Adequate control can be effected without gloves in this configuration. FIG. 11 shows the configuration for highest speed descent. This configuration should be used only by highly trained individuals wearing gloves. FIG. 3 shows the configuration for slow, finger-controlled, glove-free descent and is most useful for rescue operations or when carrying heavy equipment.

The unique descender design of the invention incorporates a cross-bar 19 through the upper portion of the figure-of-eight, which both permits the rigging of the alternative configurations detailed above and also prevents the rappel line from overlapping and abrading itself. Additional features of the descender of the invention are the vertical stays 20 which extend downward from the upper portion of the figure-of-eight and which prevent the rappel line from slipover and knotting. These vertical stays also overcome the danger of puncture wounds which could be sustained by the user using conventional horned figure-of-eight designs and further permit tie-off of the line for hands-free operation during descent.

The descender is made from 7075 aluminum alloy, conforming to Federal Specification QQ-A-250/13 and has a tensile strength approaching 63,000 psi. The descender is polished and surface coated to accommodate the features of the tubular duPont Kevlar, Akzo Twaron or similar lightweight, high tensile strength synthetic polymer rappel line of the invention.

The following table details the specifications of various sized rappel rescue systems of the invention:

| Length of Line (feet) | Shape of Carrier (Inches) | Thickness of Carrier Off Harness (Inches) | Total Carrier Weight (Pounds) |
|---|---|---|---|
| 40 | 7.75 × 5.50 oval | 2.25 | 2.1 |
| 60 | 8.75 × 6.50 oval | 2.25 | 2.8 |
| 110 | 9.00 × 7.00 oval | 3.50 | 4.0 |
| 160 | 9.50 × 8.75 oval | 4.00 | 5.8 |

The rappel line of lightweight tubular woven duPont Kevlar aramid fiber webbing has a specified tensile strength of 8,000 pounds or more. The line can be constructed with a three foot reinforced section at the front end for increased strength at the anchor point. A reinforced eyelet can be sewn on to the front end of the line to accommodate the carabiner and to prevent possible knot failure when anchoring. A steel end-ring is provided on the tail end of the line to prevent the user from accidently running off the end. Kevlar, Twaron, and like materials in this application, exhibit greater resistance to cutting, elongation and heat than previously used rappel line materials such as nylon, dacron or polyester.

While the preferred embodiments of the invention have been described, modifications could be made and other embodiments could be devised without departing from the spirit of the invention and within the scope of the appended claims.

What is claimed is:

1. A rappel rescue system adapted to be worn by rescue personnel which comprises a body harness, a fastening means for attaching said body harness to a carrier pouch and said carrier pouch containing therein a snap ring secured to one end of a rappel line, an appropriate length of said rappel line in a deployment bag, an edge guard protective pad movable along said rappel line, a figure-of-eight descender pre-rigged on to said rappel line and an end-stop ring secured to the end of said rappel line.

2. The system of claim 1 wherein the body harness is adaptable to be worn in either a waist, seat or chest mode.

3. The system of claim 1 wherein the snap ring is a carabiner.

4. The system of claim 1 wherein the rappel line is tubularly woven aramid fiber webbing.

5. A rappel rescue system adapted to be worn by rescue personnel which comprises a body harness, a fastening means for attaching said body harness to a carrier pouch and said carrier pouch containing therein a snap ring secured to one end of a rappel line, an appropriate length of said rappel line in a deployment bag, an edge guard protective pad movable along said rappel line, said edge guard protective pad comprising a plurality of woven aramid fiber layers with layers of flexible steel banding between each pair of said woven aramid fiber layers, a figure-of-eight descender pre-rigged on to said rappel line and an end-stop ring secured to the end of said rappel line.

6. A rappel rescue system adapted to be worn by rescue personnel which comprises a body harness, a fastening means for attaching said body harness to a carrier pouch and said carrier pouch containing therein a snap ring secured to one end of a rappel line, an appropriate length of said rappel line in a deployment bag, an edge guard protective pad movable along said rappel line, a figure-of-eight descender pre-rigged on to said rappel line, said figure-of-eight descender being made from high tensile strength aluminum alloy and incorporating a horizontal cross bar in the upper section, downwardly-pointing vertical extensions from the sides of said upper section, and a lower section of approximately equal diameter to the upper sections and in the same plane therewith, and an end-stop ring secured to the end of said rappel line.

7. A rappel rescue system adapted to be worn by rescue personnel which comprises a body harness, a fastening means for attaching said body harness to a carrier pouch, said fastening means comprising two hinged velcro pads which overlap the body harness webbing and secure said webbing therebetween, and said carrier pouch containing therein a snap ring secured to one end of a rappel line, an appropriate length of said rappel line in a deployment bag, an edge guard protective pad movable along said rappel line, a figure-of-eight descender pre-rigged on to said rappel line and an end-stop ring secured to the end of said rappel line.

* * * * *